US008347764B2

(12) United States Patent
Tuan-Mu et al.

(10) Patent No.: US 8,347,764 B2
(45) Date of Patent: Jan. 8, 2013

(54) RATCHETABLE OPEN-ENDED WRENCH

(75) Inventors: Hsien-Chung Tuan-Mu, Situn District (TW); Chung-Sung Li, Situn District (TW)

(73) Assignee: Apex Tool (HK) Limited Taiwan Branch, Taichung (TW)

( * ) Notice: Subject to any disclaimer, the term of this patent is extended or adjusted under 35 U.S.C. 154(b) by 351 days.

(21) Appl. No.: 12/418,188

(22) Filed: Apr. 3, 2009

(65) Prior Publication Data

US 2009/0301271 A1 Dec. 10, 2009

Related U.S. Application Data

(63) Continuation-in-part of application No. 12/136,132, filed on Jun. 10, 2008.

(51) Int. Cl.
*B25B 13/12* (2006.01)

(52) U.S. Cl. ..... 81/179; 81/126; 81/186

(58) Field of Classification Search ..... 81/179, 81/126, 186

See application file for complete search history.

(56) References Cited

U.S. PATENT DOCUMENTS

| | | | | |
|---|---|---|---|---|
| 1,308,440 | A | 7/1919 | Morrison | |
| 1,898,388 | A | 2/1933 | Parker | |
| 2,652,735 | A | 9/1953 | Wilder | |
| 2,700,315 | A | 1/1955 | Hermanson | |
| 2,730,000 | A | 1/1956 | Crittenden | |
| 2,795,160 | A * | 6/1957 | Blasdell | 81/179 |
| 2,855,814 | A | 10/1958 | Yavner | |
| 2,879,681 | A | 3/1959 | Blasdell | |
| 2,937,551 | A | 5/1960 | Akers | |
| 3,079,820 | A | 3/1963 | Vantchoura | |
| 3,165,015 | A | 1/1965 | Hinrichs | |
| 3,717,054 | A | 2/1973 | Thompson | |
| 4,554,847 | A | 11/1985 | DeSantis | |
| 4,644,830 | A | 2/1987 | Bailey et al. | |

(Continued)

FOREIGN PATENT DOCUMENTS

CN 2057881 U 6/1990

(Continued)

OTHER PUBLICATIONS

Taiwan Patent Office Search Report for Application No. 097115950, dated Aug. 25, 2010.

(Continued)

*Primary Examiner* — Monica Carter
*Assistant Examiner* — Danny Hong
(74) *Attorney, Agent, or Firm* — Nelson Mullins Riley & Scarborough, LLP

(57) ABSTRACT

A ratchetable open-ended wrench includes a handle for a hand to grasp, a wrench head located on one end of the handle, and a fastener room located in the wrench head for accommodating a workpiece to be rotated. The wrench head further includes a first jaw having a first driving wall, a second jaw having a second driving wall facing the first driving wall, an inner wall extending from the second driving wall into the second jaw, a concavity, an auxiliary jaw retracting opening, an auxiliary jaw capable of longitudinally sliding into the auxiliary jaw retracting opening in an elastic way, and an auxiliary jaw limiting member coupled to a limiting slot. The auxiliary jaw further includes an exterior end having a pillow in contact with the driving wall and a pushing surface for working together with the first jaw to grip the workpiece under operation, an interior end, and a limiting slot.

24 Claims, 3 Drawing Sheets

U.S. PATENT DOCUMENTS

| | | | |
|---|---|---|---|
| 4,706,528 | A | 11/1987 | Inoue |
| 5,533,428 | A | 7/1996 | Pradelski |
| 5,768,958 | A | 6/1998 | Gamble |
| 6,637,300 | B2 | 10/2003 | Wu |
| 7,010,999 | B1 | 3/2006 | Wu |
| 7,077,035 | B1 | 7/2006 | Huang |
| 7,082,859 | B2 | 8/2006 | Huang |
| 7,082,862 | B2 | 8/2006 | Lee |
| 7,111,529 | B2 | 9/2006 | Pradelski |
| 7,661,337 | B2 | 2/2010 | Chen |
| 2007/0119281 | A1 | 5/2007 | Chang |
| 2008/0066585 | A1 | 3/2008 | Chiang |
| 2010/0083797 | A1 | 4/2010 | Lee |

FOREIGN PATENT DOCUMENTS

| | | | |
|---|---|---|---|
| CN | 2317047 | Y | 5/1999 |
| CN | 2868567 | Y | 2/2007 |
| DE | 102 04 805 A 1 | | 8/2003 |
| DE | 20 2005 019 936 | U1 | 2/2006 |
| EP | 2255927 | A2 | 1/2010 |
| TW | 228757 | | 8/1994 |
| TW | 278060 | | 6/1996 |
| TW | 327619 | | 3/1998 |
| TW | 501515 | | 9/2002 |
| TW | 511564 | | 11/2002 |
| TW | M262313 | | 4/2005 |
| TW | M291345 | | 6/2006 |
| TW | 200637692 | | 11/2006 |
| TW | 310772 | | 5/2007 |
| TW | M316132 | | 8/2007 |
| TW | 2000800509 | | 1/2008 |
| WO | WO 9615879 | | 5/1996 |

OTHER PUBLICATIONS

Office Action dated Nov. 9, 2009 for co-pending U.S. Appl. No. 12/136,132.

Amendment filed Feb. 5, 2010 to Office Action dated Nov. 9, 2009 for co-pending U.S. Appl. No. 12/136,132.

Final Office Action dated Mar. 15, 2010 for co-pending U.S. Appl. No. 12/136,132.

Amendment After Final filed Jul. 14, 2010 to Final Office Action dated Mar. 15, 2010 for co-pending U.S. Appl. No. 12/136,132.

Office Action dated Aug. 20, 2010 for co-pending U.S. Appl. No. 12/136,132.

Amendment filed Feb. 21, 2011 to Office Action dated Aug. 20, 2010 for co-pending U.S. Appl. No. 12/136,132.

Final Office Action dated Apr. 4, 2011 for co-pending U.S. Appl. No. 12/136,132.

Amendment After Final filed Aug. 19, 2011 to Final Office Action dated Apr. 4, 2011 for co-pending U.S. Appl. No. 12/136,132.

Office Action dated Aug. 24, 2011 for co-pending U.S. Appl. No. 12/136,132.

Office Action dated Feb. 28, 2012 for co-pending European Patent Application No. EP 10153675.3.

* cited by examiner

0°

10°

20°

30°

40°

50°

60°

RATCHETABLE OPEN-ENDED WRENCH

This application is a continuation-in-part of U.S. Ser. No. 12/136,132, filed 10 Jun. 2008, and which application is incorporated herein by reference. To the extent appropriate, a claim of priority is made to the above disclosed applications.

FIELD OF THE INVENTION

The invention relates to a ratchetable open-ended wrench which allows application of sequential back and forth strokes to a rotatable workpiece W without removing the wrench from the workpiece, and more particularly to a ratchetable open-ended wrench that achieves a "smooth, continuous operation" for the operators when retracting a workpiece W with sequential back and forth strokes.

BACKGROUND OF THE INVENTION

A ratchetable open-ended wrench is known as an improved hand tool which not only achieves the functions of conventional open-ended wrench but also provides the advantage of ratchetable operation. In view of the convenience, efforts and improvements have been made in this field, for example, Patent Nos. TW228757, TW278060, TW327619, U.S. Pat. No. 5,533,428 (WO9615879), TWM310772, U.S. Pat. Nos. 7,111,529, 7,077,035 and 3,165,015. Further, some adjustable spanners are also provided with similar ratchetable operation mechanism, such as Patent Nos. TW501515, TW511564, U.S. Pat. No. 7,010,999, TW262313, and U.S. Pat. No. 2,879,681.

TW228757 discloses an open-ended wrench which allows application of sequential back and forth strokes for driving a screw/workpiece. The wrench relies on a pair of retractable claws/jaws (2, 3) parallel to each other and disposed in the wrench head, which move along the same direction as a pair of drive springs coupled to the claws/jaws. Therefore, TW228757, which is characterized by the retractable claws/jaws (2, 3) moving back or forth along the activation direction of the springs, can rotate a screw clockwise, and turn back in a counterclockwise direction without rotating the screw. However, a wrench needs the counterforce or friction from the retractable claws/jaws, which are abutted against the screw, to tighten or loosen the screw. In this regard, the retractable claws/jaws (2, 3) of the wrench of TW228757 are formed with toothed surfaces which are parallel to each other to contact a parallel pair of sides of the screw so as to rotate the same. The problem with the wrench is that, since the toothed surfaces of the jaws are substantially parallel to each other and are not perpendicular to the screw sides, the tightening/loosening performance of the wrench is poor, and the toothed structure can be easily abraded after long-term usage. Moreover, due to the complicated jaw-pair structure, the jaw opening (the opening between the jaws) of the wrench must be made larger than the size of the screw/workpiece to be driven, and the retractable claws/jaws (2, 3) may be continuously abraded during operation. Therefore, such a wrench is inconvenient in use. Nevertheless, the through slots (111, 121) accommodating the claws/jaws weaken the wrench head structure.

U.S. Pat. No. 5,533,428 (WO9615879) and TW327619 remedy some of the above defects by providing a wrench providing a single L-shaped retractable claw/jaw 15 which moves in the same direction as a driving spring coupled therewith within a slot 23 inward facing a base portion of the wrench driving head which is near a handle 21, with a modified driving head structure. The retractable jaw 15 has a second engaging surface 14 in parallel to a first engaging surface 13 on a first jaw 11. However, the problem with this wrench is that, during the wrench "reverse rotation" at which the nut is not rotated, the wrench cannot be operated smoothly. One reason is that, the wrench reverse rotation is easily held up because a corner 75 of the nut 60 will block the retracting action of the retractable jaw 15 may tend to block the retractable jaw member 15. Though the inventions provide a chamfered edge 16 between forward surface 30 and engaging surface 14 to allow for improved ratchetability of the retractable jaw 15 to alleviate the above problem, there remain some other defects. Specifically, the driving opening of the wrench driving head is characterized by a complicated structure including bearing surface 50 and recesses 51-53 which are not smoothly connected to each other, and the jaw opening must be larger than the nut/screw/workpiece to be driven, which results in an increased weight of the wrench and inaccurate sizing of jaw opening. Besides, since the driving opening is not smoothly contoured with bearing surface 50 and recesses 51-53, during the wrench reverse rotation when the nut is not rotated, a series of sequential partial-turn strokes are required to find different points for force application. This slows the rate of each wrench reverse rotation operation. Therefore, such a wrench is very inconvenient for a professional user.

The aforementioned or similar problems exist in various other conventional wrenches, such as TWM310772, U.S. Pat. Nos. 3,165,015, 7,077,035 and 7,111,529 which use a retractable claw/jaw moving in the same direction as a driving spring coupled therewith. Another common problem of conventional wrenches is that during the tightening/loosening operation, the spring and the retractable claw/jaw directly bear a great torque, which may adversely affect the wrench service life.

U.S. Pat. No. 6,637,300 (TW501515), U.S. Pat. No. 7,010,999 (TW200637692) and TW511564 issued to Arthur Wu disclose ratchetable adjustable spanners which adopt "pivot-type claw/jaws." In particular, U.S. Pat. No. 6,637,300 discloses slots 14 which laterally penetrate a fixed jaw 11, and rotatable devices (pivoted jaws) 40, 66 with a symmetrical, paired structure pivotally fixed in said two slots 14, so that the rotatable devices 40, 66 can be clamped between stopping portions 15. With the above structure, the wrench can tighten/loosen a screw in one direction, and turn back without rotating the screw in the opposite direction. However, U.S. Pat. No. 6,637,300 has the following disadvantages: (1) The rotatable devices (pivoted claws) 40, 66 are complicated by providing symmetrical, T-shaped and paired structures. (2) The rotatable devices 40, 66 clamped between the two stopping portions 15 cannot be retracted into the slots 14 receiving said rotatable devices 40, 60, so the wrench driving opening must be made larger, which results in an increased weight, and the ratachetable structure can only be used with an "adjustable spanner" instead of an "open-ended wrench." (3) The springs 50, 67 are disposed on a pivot, so the rebounding force of the rotatable devices 40, 66 is small, and the operation performance is not good. (4) The slot 14 for accommodating the rotatable devices 40, 66 penetrates the head portion of the wrench, which weaken the strength of the wrench head. TW511564 and U.S. Pat. No. 7,010,999 (TW 200637692) change the through slot 14 of U.S. Pat. No. 6,637,300 to an arcuated, C-shaped opening to acquire a higher strength, and change the "rotatable devices (pivoted claws) 40, 66" of TW501515 with "driving rollers" activated by springs. These driving rollers are big, however. To accommodate the "driving rollers," the fixed jaw must be made larger. Moreover, the above prior arts are only applicable to an adjustable spanner which is equipped with a "moving jaw" and a "worm" so that these elements can actually engage a screw/nut/workpiece. Thus, the whole adjustable spanner with these elements is even more clumsy and inconvenient to operate.

Among various ratchetable wrenches, those with a retractable jaw moving in the same direction as a driving spring coupling therewith are simpler in structure than those with a pivot-type jaw, and thus have a lower cost. However, the conventional design of the former is highly complicated and has the following disadvantages. (1) The retractable jaw must work with a slot penetrating the fixed jaw of the wrench head, which results in a weak wrench head structure that may be easily ruptured under a great torque for a long time. (2) To engage fasteners or workpieces such as screws/nuts, the wrench is provided with a retractable jaw which is usually designed with a complicated engaging surface, or provided with several retractable jaws working together, so the difficulty in and cost of the fabrication are increased. (3) The retractable jaw is not properly designed to bear great force, and is easily broken. (4) The wrench driving opening/fastener room for accommodating a fastener or workpiece such as a screw/nut has a complicated structure, which brings inconvenience during operation.

Therefore, it is necessary to provide a ratchetable open-ended wrench to eliminate the above disadvantages.

SUMMARY OF THE INVENTION

Accordingly, the present invention is directed to a ratchetable open-ended wrench, which includes a handle for a hand to grasp, a wrench head located on one end of the handle, and a fastener room located in the wrench head for accommodating a workpiece to be rotated. The wrench head further includes a first jaw having a first driving wall, a second jaw having a second driving wall facing the first driving wall, an inner wall extending from the second driving wall toward the inside portion of the second jaw, a fastener-jaw concavity, an auxiliary jaw retracting opening, an auxiliary jaw elastically and longitudinally slidable along the auxiliary jaw retracting opening, and an auxiliary jaw limiting member coupled with the limiting slot. The auxiliary jaw further includes an exterior end having a pillow in contact with the inner wall and a pushing surface for working together with the first jaw to grip and rotate the workpiece W, an interior end, and a limiting slot.

BRIEF DESCRIPTION OF THE DRAWINGS

FIG*s*. 1A to 1B are schematic three-dimensional views of the present invention;

FIG. 2B is a plane view of F*ig*. 1B the present invention of;

DETAILED DESCRIPTION OF THE INVENTION

Figure 1A:
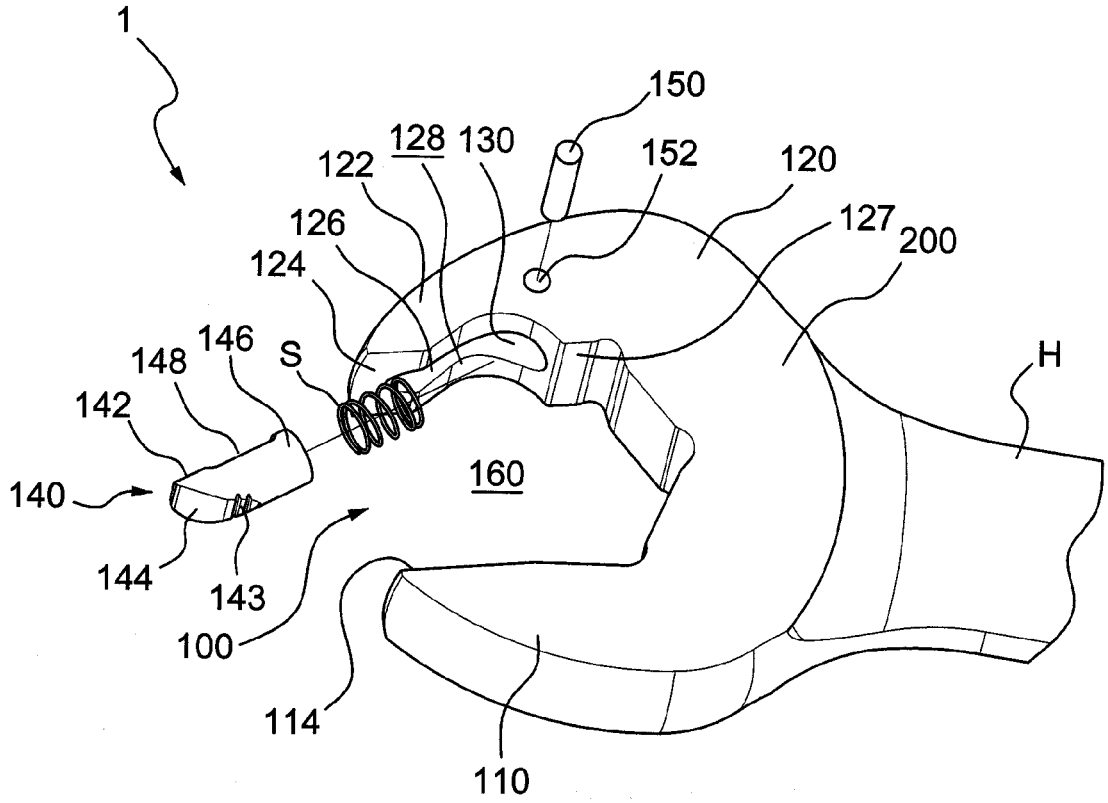
Figure 1B:
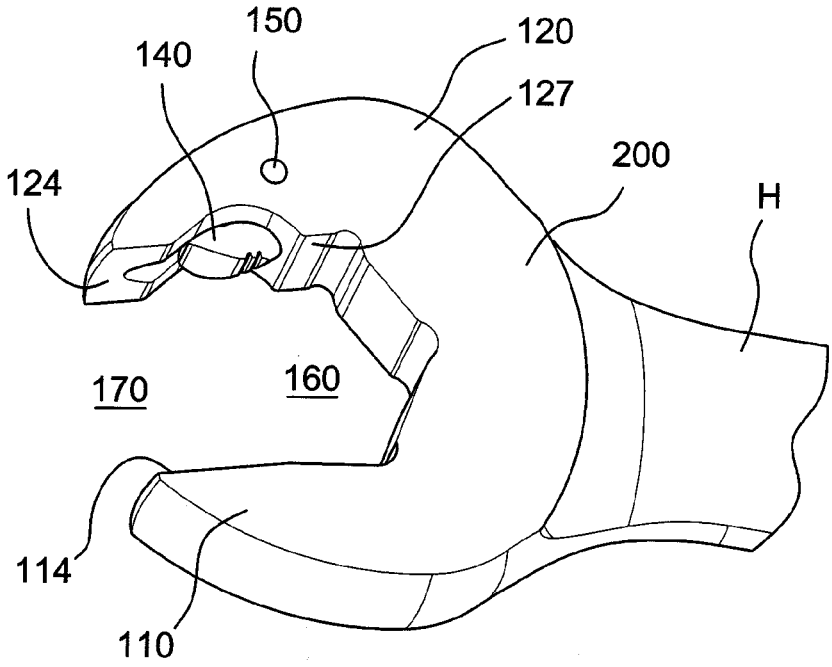

In FIGS. 1A to 2B, a preferred embodiment of a ratchetable open-ended wrench 1 for turning a rotatable workpiece W is shown. The "workpiece" refers to, for example, a fastener like screw/nut, or any other hand tool having a polygonal driven part and capable of being driven by a wrench. However, the workpiece W hereinafter only stands for to the driven part of the workpiece W (e.g., a bolt head or a driven end of an adaptor) that is driven by the wrench. The ratchetable open-ended wrench 1 substantially comprises a handle H for a hand to grasp and a wrench head 100 for rotating the workpiece W, which includes a drive opening therein and located on one end of the handle H.

The wrench head 100 preferably includes a first jaw 110 having a first driving wall 114, a second jaw 120 substantially extending from a base portion 200 of the wrench head 100 adjoining the handle to a free end 122, and a fastener room 160 located in the drive opening of the wrench head 100 for accommodating the workpiece W to be rotated.

The first jaw 110 is preferably formed with a recessed portion 112 capable of accommodating the angled portion of the workpiece W is an inner section (a section away from the first driving wall 114) thereof (see FIG. 2A) to facilitate smooth operation during the reverse rotation of the wrench at which the workpiece W is not rotated. According to an alternative embodiment, the recessed portion 112 of the first jaw 110 may be omitted, and the inside portion of the second jaw 120 is made larger so as to accommodate the workpiece W during the reverse rotation of the wrench without rotating the workpiece W. In this alternative embodiment, although the weight of the wrench is increased, the functions of the wrench of the present invention can still be achieved.

The second jaw 120 comprises:

- a second driving wall 124, formed on the free end 122 of the second jaw 120 and facing the first driving wall 114;
- an inner wall 126, extending from the second driving wall 124 toward the inside portion of the second jaw 120;
- a rear-end wall 127 provided adjacent to the base portion 200, said rear-end wall 127 facing said first jaw 110 so as to work with said first jaw 110 to clamp a portion of the workpiece W to be rotated;
- a concavity 128 formed between said second driving wall 124 and said rear-end wall 127 and having a wall forming a portion of said inner wall 126;
- an auxiliary jaw retracting opening 130, which extends from the base portion 200, faces a jaw opening 170 (which will be explained below) and adjoins the concavity 128, wherein the auxiliary jaw retracting opening 130 preferably does not penetrate the second jaw 120;
- an auxiliary jaw 140, partially disposed in the auxiliary jaw retracting opening 130, and elastically (see a spring S in the drawings) and longitudinally slidable along the auxiliary jaw retracting opening 130;
- an interior end 146 for elastically coupled to the auxiliary jaw retracting opening 130 (with the spring S);
- a limiting slot 148; and
- an auxiliary jaw limiting member 150, extending (from a surface of the second jaw 120) through an opening 152 to the auxiliary jaw retracting opening 130, and coupled with the limiting slot 148, for confining the auxiliary jaw 140 to move between a first position in which the auxiliary jaw 140 is non longitudinally biased and a second position in which the auxiliary jaw 140 is longitudinally biased.

The inner wall 126 is preferably formed with a slot having a U-shaped cross-section so as to allow the auxiliary jaw 140 to slide thereon. Specifically, the U-shaped slot extends from the auxiliary jaw retracting opening 130 toward the jaw opening 170 and has a longitudinal opening facing the auxiliary jaw 140. Therefore, the auxiliary jaw 140 can be partly embraced in the U-shaped inner wall 126 during its movement in the slot.

The rear-end wall 127 is preferably arranged in a way that it does not exceed a half of a workpiece contact edge WS that is adjacent to the base portion 200 (i.e., the rear-end wall 127 does not exceed an inner half portion of the workpiece contact edge WS). Accordingly, when the open-ended wrench 1 is used to roatate a workpiece W, the rear-end wall 127 will share a part of the torque required to drive the workpiece W; whereas when the open-ended wrench 1 is ratcheted back with no loosening/tightening action, the rear-end wall 127 will not obstruct the movement of the auxiliary jaw 140 relative to the associated contact edge WS of the workpiece W. Preferably, the smallest width between the rear-end wall 127 and the first driving wall 114 of the first jaw 110 is approximately the size of the workpiece W.

Figure 2A:
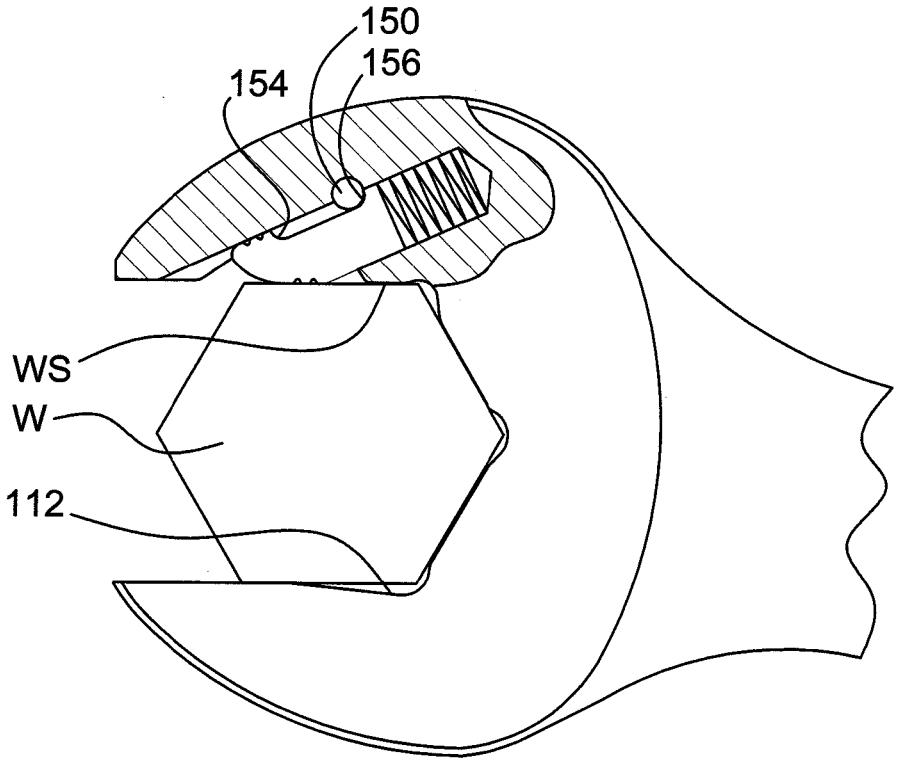
FIG. 2A is a plane view of the present invention.
Figure 2B:
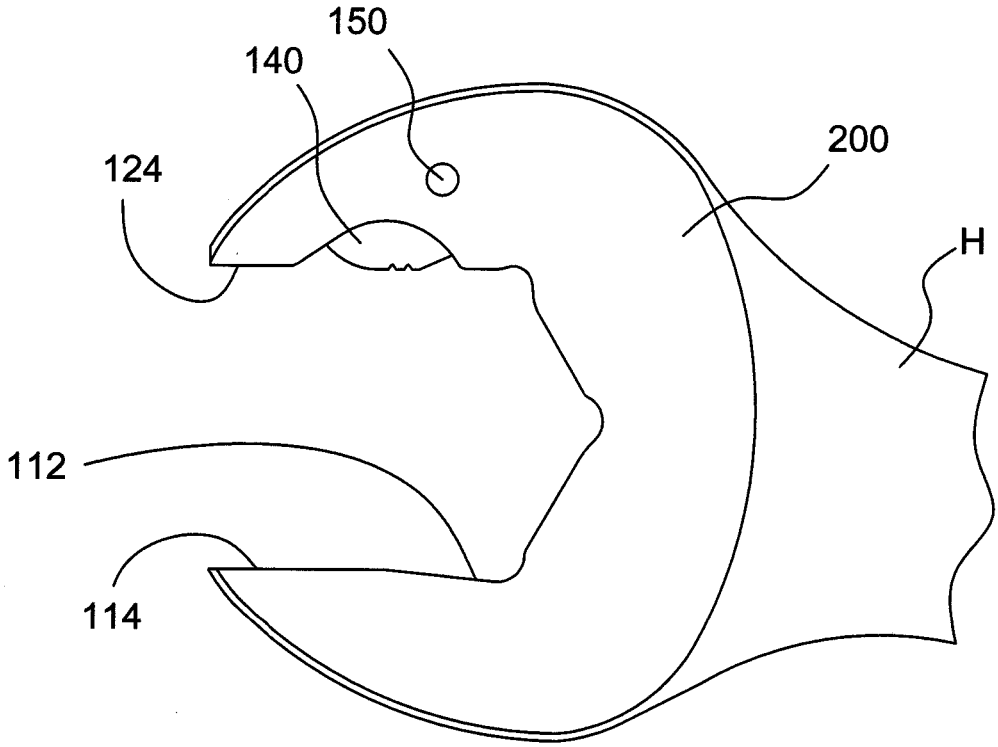

The auxiliary jaw 140 preferably comprises a pillow 142 facing the inner wall 126 for contacting/abutting it and a "fastener contact surface" for contacting the workpiece W. The "fastener contact surface" comprises a driving surface 143 and a pushing surface 144. Preferably, when the auxiliary jaw 140 is located in the first position in which the auxiliary jaw 140 is unbiased and fully extended by spring S, the minimum width between the "fastener contact surface" thereof and the first driving wall 114 of the first jaw 110 is substantially equal to the size of the workpiece W. The driving surface 143 substantially faces a workpiece contact edge WS of the workpiece W to be rotated, so that it can work with the first jaw 110 to grip the workpiece W and apply a force (torque) thereto during operation. The driving surface 143 is preferably formed with corrugations shown in the drawings or similar friction structure to obtain a better gripping force. The pushing surface 144 is substantially directed toward the drive opening and adjacent to the portion of the workpiece contact edge WS that is away from the base portion 200 (which means that the pushing surface 144 faces an outer portion of the contact edge WS, as shown in FIG. 2A), so that it can be pushed by the outer portion of the contact edge WS of the workpiece W to be rotated when the ratchetable open-ended wrench 1 is ratcheted back with no loosening/tightening action, while at the same time the auxiliary jaw 140 is retracted into the auxiliary jaw retracting opening 130 as workpiece W enters the concavity 128. The pushing surface 144 preferably includes a gentle cambered/curved surface. The driving surface 143 is connected to the pushing surface 144 preferably by a smooth cambered/curved surface. More specifically, the "fastener contact surface" of the auxiliary jaw 140 extends with a curved surface from the driving surface 143 to the pushing surface 144 (that is, the pushing surface 144 itself has a cambered/curved surface, and the pushing surface 144 is connected to the driving surface 143 by a cambered/curved surface), thereby making the workpiece W smoothly slide from the driving surface 143 to the pushing surface 144. With this configuration, when the ratchetable open-ended wrench 1 is ratcheted back without rotating the workpiece W from a gripping position (holding the workpiece W), a smooth, continuous operation can be obtained. Accordingly, users who tighten/loosen the workpiece W by the ratchetable open-ended wrench 1 of the present invention can perform a series of smooth, continuous operation steps, including inserting the ratchetable open-ended wrench 1 to the workpiece W, rotating the workpiece W by the wrench 1, and ratcheting the wrench 1 back without loosening/tightening the workpiece W. Compared with prior art references such as U.S. Pat. Nos. 5,533,428 and 7,111,529 in which the back-ratcheting rotation require a series of sequential partial-turn strokes which are not continuous or smooth due to the complicated wrench head structures (in these patents, users must partially "move" the wrench during back-ratcheting operation of the wrench to find appropriate positions for force application), the present invention significantly improves back-ratcheting operation of the wrench.

Advantageously, with the above structure, when the open-ended wrench 1 of the present invention is the driving operation, the rear-end wall 127 and the driving surface 143 of the auxiliary jaw 140 work together to provide the torque required to drive the workpiece W; whereas when the open-ended wrench 1 is ratcheted back with no loosening/tightening action, the pushing surface 144 of the auxiliary jaw 140 can be pushed by the outer portion of the contact edge WS of the workpiece W and the end of rear-end wall 127 will not obstruct the movement of the auxiliary jaw 140 relative to the associated contact edge WS of the workpiece W. Therefore, a smooth operation of the open-ended wrench 1 can be obtained no matter if it is in the driving operation or reverse operation.

The limiting slot 148 is preferably in the form of a longitudinal notch located on one side of the auxiliary jaw 140, and defined between a shoulder 154 of the pillow 142, a shoulder 156 of the interior end 146, and the inner wall 126. According to this embodiment, the limiting slot 148 is a notch having a U-shaped structure near a side of the auxiliary jaw 140, and is surrounded by the inner wall 126 so as to work as a groove/slot. With this structure, the auxiliary jaw limiting member 150 is coupled in the limiting slot 148, so that auxiliary jaw 140 moves between a first position (at which the auxiliary jaw 140 is unbiased by the workpiece W and fully extended by the spring S) and a second position (in which the auxiliary jaw 140 is biased and fully compressed by the workpiece W), due to the blocking of the shoulders 154 and 156. According to another embodiment of the present invention, the limiting slot 148 is a longitudinal notch substantially located in the auxiliary jaw 140 and spaced a distance (not shown) from the periphery of the auxiliary jaw 140 and the inner wall 126.

Preferably, in order to achieve a better effect, the included angle between the driving surface 143 and a longitudinal centerline of the auxiliary jaw 140 is made as small as possible, so that when the user uses the ratchetable open-ended wrench 1 to rotate (tighten or loosen) the workpiece W, at least a large part of or the overall torque on the auxiliary jaw 140 is converted into a component force along the radial direction of the auxiliary jaw 140. In another preferred embodiment, the pushing surface 144 of the auxiliary jaw 140 extends from an end adjacent to the inner wall 126 to the driving surface 143 preferably shaped as a gentle cambered/curved surface. With this feature, during the back-ratcheting operation of the wrench 1 without rotating the workpiece W, a direction of force application between the contact edge WS of the workpiece W and the pushing surface 144 is mostly or almost parallel to the longitudinal centerline of the auxiliary jaw 140 (or of the auxiliary jaw retracting opening 130), so all or most of the force applied to the pushing surface 144 can be parallel to the longitudinal centerline of the auxiliary jaw 140, thus reducing the abrasion between the pillow 142 and the inner wall 126.

The fastener room 160 is used to accommodate the workpiece W to be rotated, which is substantially located between the auxiliary jaw 140 and the first driving wall 114, and adjoins the concavity 128. The fastener room 160 and the concavity 128 work together in such a way that they form a working space which is sufficiently large to allow the workpiece W to remain therein for a full 360-degree turn of the wrench head 100/handle H. Therefore, whenever the ratchetable open-ended wrench 1 is operated to rotate the workpiece W or is ratcheted back without rotating the same, there is no need to remove the wrench 1 from the workpiece W. That is, the steps of rotating the workpiece W by the wrench 1 and ratcheting the wrench 1 back without rotating the workpiece W can be completed with the workpiece W remaining in the working space formed by the fastener room 160 and the concavity 128.

A jaw opening 170 is defined between the first driving wall 114 of the first jaw 110 and the second driving wall 124 of the second jaw 120. The width of the jaw opening 170 is substantially the same as the size of the workpiece W to be rotated, so that the first jaw 110 together with the second jaw 120 may tighten/loosen the workpiece W as a typical open-ended wrench.

In prior art references such as U.S. Pat. No. 7,111,529, in order to provide the function of back-ratcheting rotation without loosening/tightening action, the width of the jaw opening of the wrench must be larger than the workpiece W (i.e., the size of the jaw opening is inconsistent with that of the workpiece W) with the complicated structure of the fastener room and the auxiliary jaw 11 facing the base area 19. Moreover, cover plates 23, 25 and a welding process are required. An advantage of the present invention is that the width of the jaw opening 170 can be made substantially the same size as that of the workpiece W to be rotated. This allows the appearance and size of the wrench head 100 of the ratchetable open-ended wrench 1 of the present invention to be almost identical to those of conventional open-ended wrenches without ratchetable functions. The ratchetable open-ended wrench 1 can be manufactured with less material, and can be applied to small-sized wrenches for small workpieces W. Further, as indicated above, according to the present invention, the minimum width between the "fastener contact surface" of the auxiliary jaw 140 and the first driving wall 114 of the first jaw 110 may be substantially equal to the size of the workpiece W. Thus, the overall operation, including gripping the workpiece W with the jaw opening 170 of the ratchetable open-ended wrench 1, rotating the workpiece W by the wrench 1, ratcheting the wrench 1 back without loosening/tightening the workpiece W, and again rotating the workpiece W again, is very smooth. Another advantage is that the auxiliary jaw retracting opening 130 of the present invention is formed in the base portion 200, which does not need the cover plates of U.S. Pat. No. 7,111,529 or a welding process. The above advantages are a great improvement as compared with the prior arts.

Figure 3A:
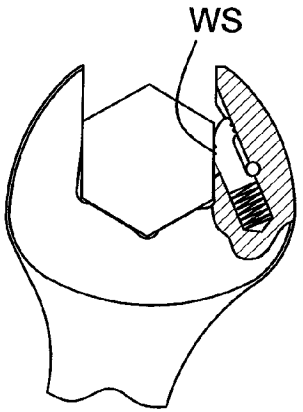
FIGS. 3A to 3G are schematic views showing the wrench reverse rotation operation during which the workpiece is not rotated according to the present invention.
Figure 3B:
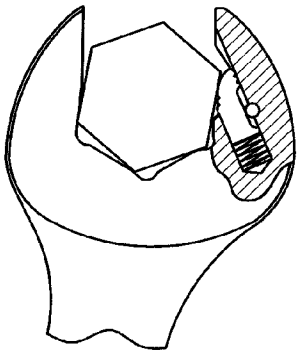
Figure 3C:
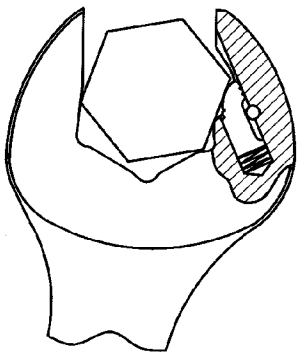
Figure 3D:
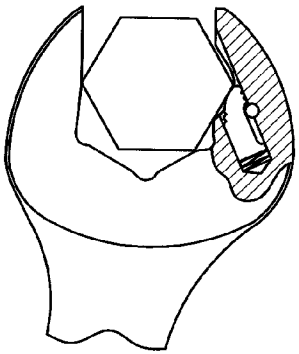
Figure 3E:
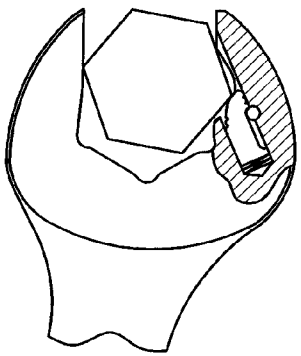
Figure 3F:
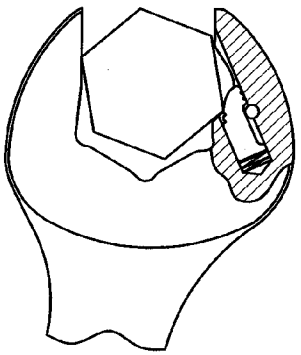
Figure 3G:
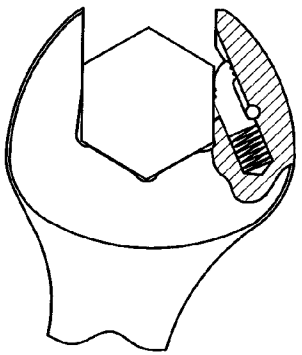

FIGS. 3A to 3G are schematic views showing how the back-ratcheting movement of ratchetable open-ended wrench 1 without loosening/tightening the workpiece W is achieved. The workpiece W is a hexagonal nut, so each back-ratcheting movement of wrench 1 around an angle of workpiece W requires a turn of 60°, as illustrated in FIGS. 3A to 3G. FIGS. 3A-3B, 3B-3C, 3C-3D and 3D-3G show the relative positions between the auxiliary jaw 140 and the contact edge WS of the workpiece W each time the wrench head 100 turns back 10°. In FIG. 3A, the auxiliary jaw 140 reaches the first position in which the workpiece W does not longitudinally bias the auxiliary jaw 140, with the driving surface 143 preferably close to the contact edge WS. In this position, the auxiliary jaw 140 and the rear-end wall 127 work with the first jaw 110 to grip the nut. Accordingly, if the ratchetable open-ended wrench 1 turns in the clockwise direction, the nut can be tightened/loosened. As shown in FIG. 3B, when the ratchetable open-ended wrench 1 turns in the counterclockwise direction, the counterforce applied by the nut to the pushing surface 144 forces the auxiliary jaw 140 to retract into the auxiliary jaw retracting opening 130 and travel toward the base portion 200, in which step the auxiliary jaw 140 moves from the first position to the second position in which the auxiliary jaw 140 is in a fully compressed position closest to base portion 200. Since the length of the rear-end wall 127 should not obstruct the back-ratcheting operation, it is preferred that the end of the rear-end wall 127 should not exceed the inner half portion of the workpiece contact edge WS of the workpiece W to be rotated. Further, as shown in FIGS. 3C to 3G, by continuing turning the wrench 1 to pass around an angle of the nut (as shown in FIG. 3F), the auxiliary jaw 140 returns to its first position (as shown in FIG. 3G) fully extended by the spring S. Thus, the wrench 1 is ready for another tightening/loosening action in the clockwise direction again.

All the above descriptions are intended to demonstrate the preferred embodiments of the present invention rather than limit the present invention. Since the present invention is not limited to the specific details described in connection with the preferred embodiments, changes to and implementations of certain features of the preferred embodiments without altering the overall basic function of the invention are contemplated within the scope of the appended claims.

What is claimed is:

1. A ratchetable open-ended wrench for turning a rotatable workpiece, comprising:

a wrench head for rotating the workpiece, which includes a drive opening therein, comprising:

a first jaw including a first driving wall;

a second jaw substantially extending from a base portion of the wrench head to a free end, and comprising:

a second driving wall, formed on the free end of the second jaw and facing the first driving wall;

an inner wall, extending from the second driving wall to an inside portion of the second jaw;

a rear-end wall provided adjacent to the base portion, said rear-end wall facing said first jaw so as to work with said first jaw to clamp a portion of the workpiece to be rotated;

a concavity formed between said second driving wall and the rear-end wall;

an auxiliary jaw retracting opening, extending from the base portion and adjoining the concavity;

an auxiliary jaw elastically and longitudinally slidable along the auxiliary jaw retracting opening, comprising:

a pillow facing the inner wall;

a fastener contact surface for contacting the workpiece, comprising:

a driving surface, substantially disposed adjacent a workpiece contact edge; and a pushing surface, substantially directed toward said drive opening and provided adjacent the portion of the workpiece contact edge that is away from the base portion;

an interior end elastically coupled to the auxiliary jaw retracting opening;

a limiting slot;

an auxiliary jaw limiting member, coupled with the limiting slot, for confining the auxiliary jaw to move between an unbiased first position and a biased second position; and a fastener room, located between the auxiliary jaw and the first driving wall and adjoining the concavity, wherein the concavity and the fastener room together forms a working space which is sufficiently large to allow the workpiece to remain therein for a full 360-degree turn of the wrench head.

2. The ratchetable open-ended wrench according to claim 1, wherein a width between the first driving wall of the first jaw and the second driving wall of the second jaw is substantially equal to a size of the workpiece.

3. The ratchetable open-ended wrench according to claim 1, wherein a minimum width between the fastener contact surface of the auxiliary jaw and the first driving wall of the first jaw is substantially equal to a size of the workpiece, and wherein a minimum width between the rear-end wall and the first driving wall is substantially equal to the size of the workpiece.

4. The ratchetable open-ended wrench according to claim 1, wherein the inner wall is formed with a slot having a U-shaped cross-section so as to allow the auxiliary jaw to slide thereon.

5. The ratchetable open-ended wrench according to claim 1, wherein the pushing surface of the auxiliary jaw is arc-shaped.

6. The ratchetable open-ended wrench according to claim 1, wherein the fastener contact surface of the auxiliary jaw is characterized in that the pushing surface and the driving surface are connected through a curved surface.

7. The ratchetable open-ended wrench according to claim 1, wherein the limiting slot is defined as a longitudinal notch between a shoulder of the pillow, a shoulder of the interior end and the inner wall.

8. The ratchetable open-ended wrench according to claim 1, wherein the limiting slot is a longitudinal notch substantially located in the auxiliary jaw and spaced a distance from a periphery of the auxiliary jaw.

9. The ratchetable open-ended wrench according to claim 1, wherein a recessed portion is formed on an inner section of the first jaw.

10. A ratchetable open-ended wrench for turning a workpiece having a drive end with at least one pair of opposed contact edges, comprising:

a handle with a first end;

a wrench head including a base portion disposed adjacent the first end of the handle;

a first jaw extending outwardly from the base portion of the wrench head, the first jaw including a first driving wall disposed in a first plane;

a second jaw extending outwardly from the base portion of the wrench head such that the first jaw and the second jaw define a drive opening configured to receive the drive end of the fastener, the second jaw including a rear-end wall disposed in a second plane adjacent the base portion of the wrench head, the rear-end wall being substantially parallel to the first driving wall; and an auxiliary jaw including a driving surface, the auxiliary jaw being slidably received in the second jaw such that the driving surface of the auxiliary jaw extends outwardly into the drive opening and the rear-end wall is disposed between the auxiliary jaw and the base portion of the wrench head, wherein the drive end of the fastener is slidably receivable in the drive opening of the wrench head such that the fastener can be rotated in a first direction by the first driving wall and the rear-end wall.

11. The ratchetable open-ended wrench according to claim 10, wherein the first driving wall and the rear-end wall are separated by a first width that is substantially equal to a second width that separates the at least one pair of opposed contact edges of the drive end of the fastener from each other.

12. The ratchetable open-ended wrench according to claim 11, wherein the second jaw further comprises a second driving wall such that the auxiliary jaw is slidably received in the second jaw between the second driving wall and the rear-end wall.

13. The ratchetable open-ended wrench according to claim 12, wherein the driving surface of the auxiliary pawl and the second driving wall are disposed within the second plane in which the rear-end wall lies when the auxiliary jaw is in a first position in which it is fully extended into the drive opening.

14. The ratchetable open-ended wrench according to claim 12, wherein the second jaw further comprises a concavity formed by a concave wall that extends from the rear-end wall to the second driving wall.

15. The ratchetable open-ended wrench according to claim 12, wherein the fastener is rotatable in the first direction by the first driving wall in combination with the drive surface of the auxiliary jaw and the second driving wall when the drive end of the fastener is partially received within the drive opening of the wrench head and rotatable in the first direction by the first driving wall in combination with the rear-end wall and the driving surface of the auxiliary pawl when the drive end of the fastener is fully received within the drive opening of the wrench head.

16. The ratchetable open-ended wrench according to claim 12, wherein the auxiliary jaw is urged inwardly into the second jaw when the wrench head is rotated about the fastener in a second direction.

17. The ratchetable open-ended wrench according to claim 10, wherein the fastener is rotatable in the first direction by the first driving wall in combination with the rear-end wall and the driving surface of the auxiliary pawl.

18. A ratchetable open-ended wrench for turning a workpiece having a drive end with at least one pair of opposed contact edges, comprising:

a handle with a first end;

a wrench head including a base portion disposed adjacent the first end of the handle;

a first jaw extending outwardly from the base portion of the wrench head, the first jaw including a first driving wall disposed in a first plane;

a second jaw extending outwardly from the base portion of the wrench head such that the first jaw and the second jaw define a drive opening configured to receive the drive end of the fastener, the second jaw including a rear-end wall disposed adjacent the base portion of the wrench head and a second driving wall, both the rear-end wall and the second driving wall being disposed in a second plane; and an auxiliary jaw including a driving surface, the auxiliary jaw being slidably received in the second jaw such that the driving surface of the auxiliary jaw extends outwardly into the drive opening, wherein the auxiliary jaw is slidably received in the second jaw between the second driving wall and the rear-end wall.

19. The ratchetable open-ended wrench according to claim 18, wherein the drive end of the fastener is slidably receivable in the drive opening of the wrench head such that the fastener can be rotated in a first direction by the first driving wall and the rear-end wall.

20. The ratchetable open-ended wrench according to claim 19, wherein the fastener is rotatable in the first direction by the first driving wall in combination with the drive surface of the auxiliary jaw and the second driving wall when the drive end of the fastener is partially received within the drive opening of the wrench head and rotatable in the first direction by the first driving wall in combination with the rear-end wall and the driving surface of the auxiliary pawl when the drive end of the fastener is fully received within the drive opening of the wrench head.

21. The ratchetable open-ended wrench according to claim 18, wherein the first driving wall and the rear-end wall are substantially parallel and separated by a first width that is substantially equal to a second width that separates the at least one pair of opposed contact edges of the drive end of the fastener from each other.

22. The ratchetable open-ended wrench according to claim 18, wherein the driving surface of the auxiliary pawl is disposed within the second plane in which the rear-end wall and the second driving wall lie when the auxiliary jaw is in a first position in which it is fully extended into the drive opening.

23. The ratchetable open-ended wrench according to claim 18, wherein the second jaw further comprises a concavity formed by a concave wall that extends from the rear-end wall to the second driving wall such that the auxiliary jaw extends outwardly into the concavity.

24. The ratchetable open-ended wrench according to claim 18, wherein the auxiliary jaw is urged inwardly into the second jaw when the wrench head is rotated about the fastener in a second direction.

* * * * *